US009616979B1

(12) United States Patent
Ritter

(10) Patent No.: US 9,616,979 B1
(45) Date of Patent: Apr. 11, 2017

(54) SHARK AVOIDANCE SYSTEM AND METHOD

(71) Applicant: Erich K. Ritter, Pensacola, FL (US)

(72) Inventor: Erich K. Ritter, Pensacola, FL (US)

( * ) Notice: Subject to any disclaimer, the term of this patent is extended or adjusted under 35 U.S.C. 154(b) by 0 days.

(21) Appl. No.: 14/956,453

(22) Filed: Dec. 2, 2015

(51) Int. Cl.
*B63C 9/05* (2006.01)

(52) U.S. Cl.
CPC ..... *B63C 9/05* (2013.01)

(58) Field of Classification Search
CPC ..... B63C 9/065; B63C 9/05
See application file for complete search history.

(56) References Cited

U.S. PATENT DOCUMENTS 676,836 A * 6/1901 Brown ..... B63C 9/02 441/86
3,428,978 A 2/1969 Johnson
3,986,220 A 10/1976 Johnson
9,150,293 B1 10/2015 Swerdlin
2012/0252290 A1* 10/2012 Lee ..... B63C 9/065 441/87

* cited by examiner

*Primary Examiner* — Edwin Swinehart
(74) *Attorney, Agent, or Firm* — J. Nevin Shaffer, Jr.

(57) ABSTRACT

An open ended enclosure with a top, sides, and a bottom, where the sides and the bottom form an interior enclosed space. A buoyant device and an inflatable device are provided, where the buoyant device and the inflatable device are connected to form a combination and where the combination is connected with the top of the open ended enclosure. The sides connect the top and the bottom and the sides form a flexible wall and where the flexible wall consists of a combination of at least three layers, a first, outer, layer, a second, middle, layer and a third, inner, layer. The third layer is connected to the second layer and the second layer is connected to the first layer, and, further, the first layer is a water impervious layer, the second layer is a bioelectrical blocking layer and the third layer is a sound emission blocking layer.

20 Claims, 2 Drawing Sheets

SHARK AVOIDANCE SYSTEM AND METHOD

FIELD OF THE INVENTION

This invention relates to an improved shark avoidance device. In particular, in accordance with one embodiment, the invention relates to an improved shark avoidance system consisting of an open ended enclosure with a top, sides, and a bottom, where the sides and the bottom form an interior enclosed space. A buoyant device and an inflatable device are provided, where the buoyant device and the inflatable device are connected to form a combination and where the combination is connected with the top of the open ended enclosure. The sides connect the top and the bottom and the sides form a flexible wall and where the flexible wall consists of a combination of at least three layers, a first, outer, layer, a second, middle, layer and a third, inner, layer. The third layer is connected to the second layer and the second layer is connected to the first layer, and, further, the first layer is a water impervious layer, the second layer is a bioelectrical blocking layer and the third layer is a sound emission blocking layer for blocking human produced sounds.

BACKGROUND OF THE INVENTION

A problem exists with regard to the issue that arises when a person is in open water. The issue is sharks. People and sharks are naturally wary of each other and it is an ongoing and age old fear to get bitten by sharks. Thus many shark repellents, gadgets and suggestions have been created and made. The objective and function of a proper shark repellent is to do two things: keep a person safe based on its protection effect and encourage the shark to move on, or to not be interested in the person in the first place. Since the mid 70s when "Jaws" came alive on the big screen, people of the Western hemisphere started to live in fear when entering the water. During that time (70's) basically two gadgets were available for commercial use: the "shark chaser" and the "bang stick." The latter was a stick with an explosive head, that detonated on contact with the shark. This device, although somewhat popular, required a person to shoot an animal thus a person had to get close to one. Further, this device needed to be reloaded after each explosion. Furthermore, a shark that was not immediately killed could attract other sharks through its struggle (sounds produced) which then created another more dangerous scenario that could not be controlled anymore. So after a kill, the person's best bet was to immediately leave the water. But the problem left after that was what if the person could not leave the water? What if a person was in the water after a ship was wrecked and the person was floating in open water? The shark problem would remain. Beside that is also the practical side: a repellent should be small enough that it would easily fit together with other devices e.g. life jackets, be easily stored (and forgotten until needed), and be part of personal rescue equipment on airplanes etc. Poles with explosives are not so easily stored and used.

Another prior art device was the "shark chaser", a blue powder, made of a copper acetate-negrosine dye mixture, that could be released into the water once sharks showed up. This product was produced on a big scale. The main buyer, the US Navy, believed in its effectiveness. However, the substance was dropped after a few years since an effect could never be established. The only positive effect of this powder was a psychological one since seamen believed they could now repel a shark and thus were less nervous. But even if the dye had an effect, how would a situation with sharks and the person develop once the effect was gone as in diluted by too much current for example?

Both of these "repellents"—the bang stick and the shark chaser—focused on the immediate situation, completely ignoring that the after-effect is important as well and ignoring the possible solution of not getting in contact with a shark in the first place.

In the 90s other forms of repellents came on the market, electrical gadgets, like the "shark pod," which operates by creating an electrical field surrounding a diver. Although this research is encouraging, the current devices are clumsy, expensive and might not work properly if not constantly maintained or charged. Furthermore it entails the use of electrical parts in water that can corrode or burn the diver should it be in contact with the person's skin.

Shark repellents have focused on the very moment a shark appears and how the animal can be repelled. But that is not sufficient for a repellent. A repellent also needs to offer a solution when a shark does not leave after initial contact as described above.

One shark repellent that was patented in the mid 70s, the so called "shark screen," (U.S. Pat. No. 3,428,978) offered a workable idea but focused on capturing human fluids, as it was believed back then that human fluids was what would attract sharks, and not the emission of sound (far distance, also called "far-field"), and water pressure (close distance, also called "near-field"). The "shark screen" was basically a sac that a person could get into while being at sea, and keep afloat through an inflatable ring at the top. Although it did not do much, a person felt safer and more relaxed since human fluids were trapped.

Another very similar device with similar limitations was patented for a thin film bag with a closeable top designed to hide its occupant. (U.S. Pat. No. 3,986,220). It should be noted that both patented devices have inflatable top sections but neither is buoyant with out inflation. Thus, if a person can not inflate the top section the devices will collapse around them. Further, a user of these prior art devices is left to float within the device without aid. That is, there is nothing to assist a person in centering or holding himself within the device once inside it.

In another recently issued patent (U.S. Pat. No. 9,150,293), a similar bag, called an ocean survival system, uses camouflage color on its exterior in an effort to make the person "invisible" to sharks by mimicking the surrounding waters. As an expert in this field, Applicant observes that there are several problems and/or non-workable aspects to this prior art device:

incoming sharks are not guided by vision but by sound so that even though the shark may not find its "search image" (e.g. a person's sound pattern may imitate the sound of a struggling fish) it will investigate further. Thus, even a sack that matches the surrounding colors will be found and explored. Likewise, the invention's ability to contain human body fluids is not a valid "improvement" since Applicant understands that they are not shark attractants;

camouflage coloring obviously will have no effect at night and therefore would be useless half of the time; and no material exists that can imitate the surrounding waters for every given color, shade and patterns caused by wave action nor account for brighter above water background and it is observed that sharks will approach at an angle that uses the brighter above water background to make it stand out better.

Thus, there is a need in the art for a device to allow a person to avoid an encounter with a shark that does not entail electronics, does not require maintenance, and is able to be stored until use. Further, an effective shark repellent or shark avoidance device must be effective in several scenarios: it should not attract a shark, if it comes too close, and it should not attract more sharks after use, and it should make the person "unattractive" regarding the sensory system of sharks. Furthermore, if a person can not leave the water, the "repellent" must also work at night when a shark is not seen.

It therefore is an object of this invention to provide an easy to use, easy to store, non-electric, effective shark avoidance system that meets and exceeds the requirements just listed and actually finally fulfils a long felt need for a device that provides a safe haven for people in shark inhabited waters.

SUMMARY OF THE INVENTION

Accordingly, the shark avoidance system and method of the present invention, according to one embodiment, includes an open ended enclosure with a top, sides, and a bottom, where the sides and the bottom form an interior enclosed space. A buoyant device and an inflatable device are provided, where the buoyant device and the inflatable device are connected to form a combination and where the combination is connected with the top of the open ended enclosure. The sides connect the top and the bottom and the sides form a flexible wall and where the flexible wall consists of a combination of at least three layers, a first, outer, layer, a second, middle, layer and a third, inner, layer. The third layer is connected to the second layer and the second layer is connected to the first layer, and, further, the first layer is a water impervious layer, the second layer is a bioelectrical blocking layer blocking human produced bioelectrical fields and the third layer is a sound emission blocking layer blocking human produced sounds.

All terms used herein are given their common meaning so that "buoyant" identifies and describes a material that floats in water without requiring inflation, such as plastic foam forms for example only like kick boards and surf boards, and the like. "Inflatable" describes a device that is not substantially buoyant without inflation and that is capable of inflation by adding gas, such as air. Thus, it is understood to be a device that is sealed and holds air when added such that after inflation it too is buoyant.

Further, as used herein, "water impervious layer" is given its ordinary meaning such that the "water impervious layer" is formed of material that repels water with its non-porous and perhaps "waterproof" surface. "Waterproof" is used to describe a material that repels water or that is coated with a substance, such as wax or oil or plastic, which prevents an underlying membrane from getting wet or allowing water to pass though it. Any waterproof membrane or water impervious layer made of plastic, polyester or nylon, for example only and not by limitation, or membrane covered with a waterproof additive now known or hereafter developed is included within the scope of the invention.

Still further the term "bioelectrical blocking layer" describes a material such as rubber, for example only and not by limitation, that blocks biological electrical signals, as are known, produced by living things. Also, the term "sound emission blocking layer" describes a layer of material for blocking human produced sounds such as a layer of sealed gas, such as air for example only, such that the layer creates a sound barrier of gas in effect that blocks the emission of human produced sounds. Certainly any sound blocking material now known or hereafter discovered is suitable for the purposes of the present invention.

According to another aspect, the combination is connected to the top with the buoyant device such that the inflatable device is on top of the buoyant device.

In one aspect, the system further includes more than one inflatable device with each additional inflatable device connected "on top" of the other adjacent inflatable device.

In another aspect, the buoyant device consists of buoyant polyethylene foam.

In a further aspect, the inflatable device includes more than one segregated inflatable section such that each section is independently inflatable such that if one section is ruptured, the remaining sections retain their inflation. In another aspect, the system further includes an inflation tube connected with the inflatable device.

In one aspect, the first layer is polyester, the second layer is rubber and the third layer is sealed gas.

In another aspect, the system further includes a fourth layer connected with the third layer where the fourth layer is also a water impervious layer and in one aspect, the fourth layer is polyester.

According to another embodiment of the invention, a shark avoidance system includes an open ended enclosure with a top, sides and a bottom, the sides and the bottom forming an interior enclosed space. A buoyant device and two inflatable devices are provided, where the buoyant device and the two inflatable devices are connected to form a combination and where the combination is connected with the top of the open ended enclosure. The sides connect the top and the bottom, where the sides and the bottom form a flexible wall and where the flexible wall consists of a combination of at least four layers, a first, outer, layer, a second, middle, layer and a third, inner, layer, and a fourth, innermost, layer, the fourth layer connected to the third layer, the third layer connected to the second layer and the second layer connected to the first layer, where the first layer is a water impervious layer, the second layer is a bioelectrical blocking layer, the third layer is a sound emission blocking layer and where the fourth layer is a water impervious layer.

In one aspect of this invention, the combination is connected to the top with the buoyant device.

In another aspect, the inflatable devices include more than one segregated inflatable section such that each section is independently inflatable. In one aspect, the system further includes inflation tubes connected with the inflatable devices.

In a further aspect, the first layer is polyester, the second layer is rubber, the third layer is sealed gas and the fourth layer is polyester.

In another aspect, the first layer is colored and the color is selected from a group consisting of: dark blue, light blue and black.

In another aspect, the system further includes at least one handle in the interior enclosed space such that the handle(s) extend into the space and are accessible from inside the space so that a user may hold himself steady within the space without touching the sides, top or bottom of the space.

According to another embodiment of the invention, a shark avoidance method includes:

a. providing an open ended enclosure with a top, sides, a bottom, the sides and the bottom forming an interior enclosed space; and a buoyant device and an inflatable device, where the buoyant device and the inflatable device are connected to form a combination and where the combination is connected with the top of the open ended enclosure;

where the sides connect the top and the bottom, where the sides form a flexible wall and where the flexible wall consists of a combination of at least three layers, a first, outer, layer, a second, middle, layer and a third, inner, layer, the third layer connected to the second layer and the second layer connected to the first layer, where the first layer is a water impervious layer, where the second layer is a bioelectrical blocking layer and where the third layer is a sound emission blocking layer; and b. a user placing the enclosure in water and then entering the interior enclosed space through the top of the open ended enclosure such that the open ended enclosure surrounds the user.

In another aspect of this invention, the method further includes the step of inflating the inflatable device.

In one aspect, the first layer is polyester, the second layer is rubber and the third layer is sealed gas.

In another aspect, the method further includes a fourth layer connected with the third layer where the fourth layer is a water impervious layer.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
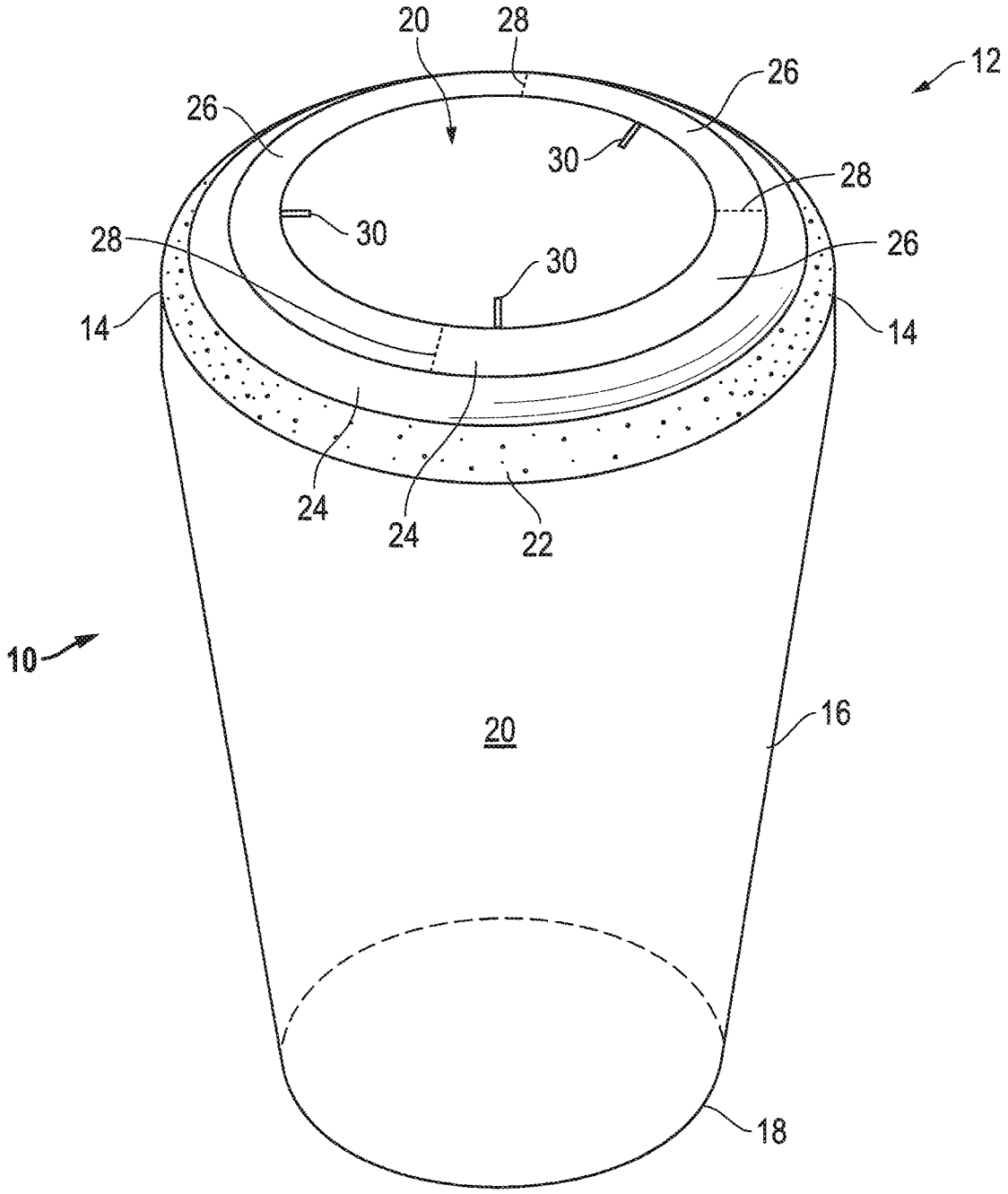
FIG. 1 is a perspective view of the shark avoidance system of the present invention.

Before explaining at least one embodiment of the invention in detail, it is to be understood that the invention is not limited in its application to the details of construction and to the arrangements of the components set fourth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

Figure 2:
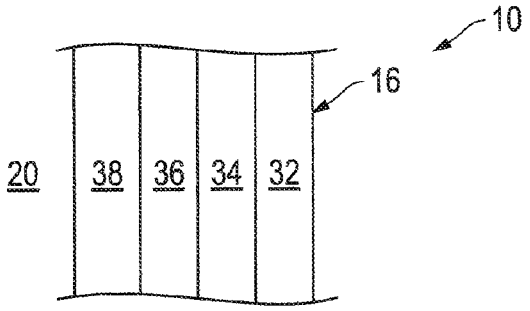
FIG. 2 is an enlarged view of the construction of the flexible side wall of the invention of FIG. 1.
Figure 3:
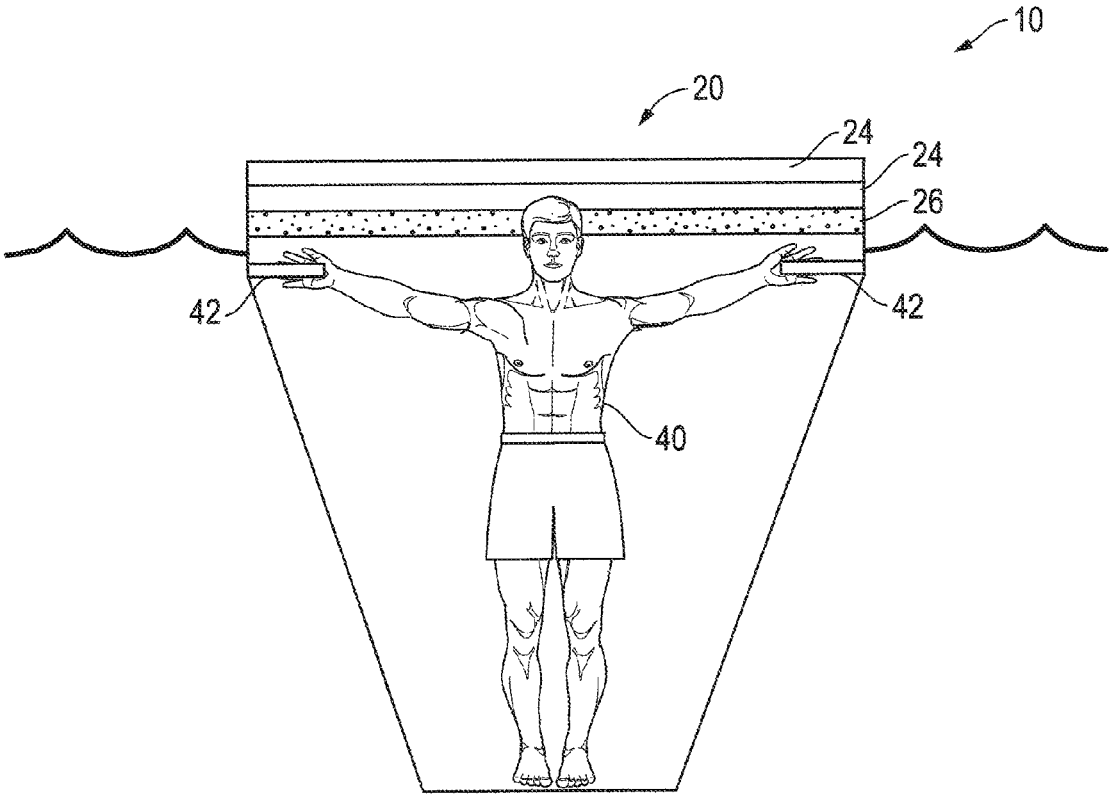
FIG. 3 is a side view of the invention of FIG. 1 with a person inside the interior space.

A preferred embodiment of the present invention is illustrated by way of example in FIGS. 1-3. With specific reference to FIG. 1, shark avoidance system 10 includes an open ended enclosure 12 with a top 14, sides 16 and bottom 18. Together the sides 16 connect to the top 14 and to the bottom 16 to form an interior enclosed space 20. Any form of open ended enclosure 12 is included within the scope of the present invention in that it may be tubular shaped, as shown, with a wider diameter at the top 14 tapering to a narrower diameter at the bottom 18. Certainly, it may also be perfectly cylindrical and, further, the sides 16 may come together such that there is no bottom 18 per se but only conjoined sides 16, not shown, and by way of example only and not by limitation.

Buoyant device 22 and inflatable device 24 are provided in combination and the combination is connected with and/or at the top 14 of open ended enclosure 12. Preferably, as illustrated, the combination is connected to the top 14 by buoyant device 22. This leaves inflatable device 24 above the buoyant device 22, as shown. By means of this structure, Applicant's invention is immediately buoyant at the top 14 without need for a user to be able to inflate it at all, thus overcoming a long felt need and serious deficiency in the art. Again, preferably, more than one inflatable device 24 is provided with additional inflatable devices 24 connected to other inflatable devices 24 as illustrated. By this means an above the water surface barrier may be created, as may be deemed useful by the user.

In one aspect of the invention, inflatable device(s) 24 are separated into several sealed sections 26 by dividers 28. This structure ensures that should one section 26 be ruptured, the inflatable device 24 still remains mostly inflated. Still further, according to one aspect, an inflation tube 30 is provided such that a user may manually inflate the inflatable device 24. Inflation tube 30 may be self sealing such that air pressure on a seal prevents air introduced into the inflatable device 24 from escaping or inflation tube 30 may include a stopper (not shown) to prevent air from escaping, all as may be deemed most useful.

Referring now to FIG. 2, an enlarged view of a section of side 16 is illustrated. Side 16 forms a flexible "wall" around the interior enclosed space 20. Preferably, side 16 includes a combination of at least three layers, a first, outer, layer 32, a second, middle, layer 34 and a third, inner, layer 36. The third layer 36 is connected to the second layer 34 and the second layer 34 is connected to the first layer 32. The connection may be by gluing or heat treating or by any means now known or hereafter developed. Preferably, the first layer 32 is a water impervious layer, the second layer 34 is a bioelectrical blocking layer and the third layer 36 is a sound emission blocking layer as described above. In a preferred embodiment, a fourth, innermost, layer 38 is provided where the fourth layer 38 is connected to the third layer 36. Again, preferably, fourth layer 38 is similar to first layer 32 and is a water impervious layer. Certainly, more of each type of layer may be added as desired or deemed useful and the layers may be attached in varying orders with the second layer 34 on the outside, for example only and not by limitation.

Referring now to FIG. 3, shark avoidance system and method 10 is illustrated with a person 40 inside interior enclosed space 20 and holding onto handle(s) 42 located on the inside of open ended enclosure 12 as illustrated. Handle(s) 42 allow a person 40 to steady himself within the open ended enclosure 12 without having to grab onto the top 14 or sides 16 or rest on the bottom 18 and thereby reduces the amount of bioelectric signals and sounds transferred to and from the open ended enclosure 12 which is a key important feature of the present invention as will be described more fully hereafter.

By way of further explanation, Applicant, as a shark behaviorist, specializes in shark-human interaction with a focus on shark attacks and their analyses. Applicant has studied what triggers a shark bite, or more importantly what lures a shark in, and what can be recommended to prevent such an incident altogether. Importantly by way of research and experimentation, Applicant has determined that pretty much every situation involving an encounter with a shark comes down to two things: sounds produced and water pressure, not as the prior art surmised human blood or urine. Neither human blood nor human urine have ever been shown to be an attractant to shark. Applicant has confirmed that it is the human sound and water pressure that act as the main trigger to attracting sharks. And the more non-rhythmical the more interested a shark gets. Sound carries a long distance in water, especially the low frequencies which can be best heard by a shark, with a spread much faster than any substance. Thus Applicant has determined that the priority in a repellent or avoidance system should be to eliminate the transmission of any human sounds into the water. Water pressure comes into play when a shark is about two body lengths away from a person. It is in a shark's nature to try to understand its environment and any unknown "thing", as a person would represent, triggers its curiosity. So a shark thus compares any unfamiliar feature with known ones to get a "better picture" of what humans represent. Water motion (pressure) suggests propulsion (equals the tail of the familiar object) and that is why a shark aims for legs or arms (should they move around quickly). As a result of his research, Applicant has determined that it is crucial that neither sounds (detected by their ears) and water pressure (detected by their lateral line system) created by a person in the water be transmitted to the water so that they do not trigger a reaction from a shark.

Again repellents can be divided into chemical, mechanical and electrical devices, active and passive ones, and must be effective in several scenarios: repel a shark, if it comes too close, should not attract more sharks after the initial repel of the first animal was made, and make the person "unattractive" regarding the sensory system of sharks. Furthermore, if a person can not leave the water, the "repellent" must also work at night when a shark is not seen.

Shark repellents have typically focused on the very moment a shark appears and how the animal can be repelled. But that is not sufficient for a repellent. A repellent also needs to offer a solution when a shark does not leave after initial contact as described. As mentioned, the main purpose of an effective shark avoidance/repellant device Applicant has determined is to eliminate human sounds and water pressure. The present invention, as no other, accomplishes that by absorbing these emissions within the open ended enclosure 12 of the present invention such that they are not transmitted beyond the system 10.

By way of the present invention, to eliminate sound produced, air, for example, is distributed throughout the third inner layer 36 of the flexible wall of side 16. This can be best accomplished through a layer 36 of material with small adjacent air pockets. A usable material would be e.g., AEROLAN-air bubble films that offer small scale air bubbles, with individual chambers of 0.4×1 mm, for example only and not by way of limitation. Water pressure is eliminated through the flexibility of the side/wall material. The outside layer 32 preferably is made out of non-destructible, waterproof material. Again, the middle layer 34 eliminates bioelectric signals and is preferably made of rubber.

Additionally, the Applicant has determined that the material color preferably should not be dark—as was used for the "shark screen"- to reduce visibility during daytime hours. Thus, a light blue is preferred although it may be that a dark blue or even black could be deemed useful in some circumstances. The inflatable rings 24 (one or more in total) at the top 14 of the bag, open ended enclosure 12, may be made of PVC and polyester, with a non-puncturable outer layer to guarantee that the enclosure surrounds the person properly. The inflatable device(s) 24 are inflatable through a mouth piece, inflation tube 30, in one aspect. Further buoyant device 22 is buoyant on its own and needs no inflation. The shark avoidance system 10 of the present invention can be folded down to a small size, easily fitting with life jackets on a boat.

Of course, popular belief is still hung up on human blood and urine as an attractant to sharks. Since both fluids would be trapped within the present invention, a person that is not aware that neither fluid is an attractant, would feel safer and so naturally keep a lower sound profile.

In sum, advantages of the present invention include but are not limited to:

- easy to get into
- eliminates sounds and water pressure, the most attractive components for any shark's interest in a human being
- eliminates bioelectrical fields, an attractant when a shark is in close vicinity to a person
- prevents human blood or urine from getting into the open water (to calm down individuals per popular belief)
- works day and night
- requires no electrical or chemical components
- requires no maintenance
- easy storage.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A shark avoidance system comprising:

a. an open ended enclosure with a top, sides, and a bottom, said sides and said bottom limning an interior enclosed space; and b. a buoyant device and an inflatable device, wherein said buoyant device and said inflatable device are connected to form a combination and wherein said combination is connected with said to of the open ended enclosure;

c. wherein said sides connect said top and said bottom, wherein said sides form a flexible wall and wherein said flexible wall consists of a combination of three layers, a first, outer, layer, a second, middle, layer and a third, inner, layer, said third layer connected to said second layer and said second layer connected to said first layer, wherein one of said layers is a water impervious polyester layer, wherein one of said layers is a bioelectrical blocking rubber layer and wherein one of said layers is a sound emission blocking layer sealad gas.

2. The system or claim 1 wherein said combination is connected to said top with said buoyant device.

3. The system of claim 1 further including more than one inflatable device.

4. The system of claim 1 wherein said buoyant device consists of buoyant polyethylene foam.

5. The system of claim 1 wherein said inflatable device includes more than one segregated inflatable section such that each section is independently inflatable.

6. The system of claim 1 further including an inflation tube connected with said inflatable device.

7. The system of claim 1 wherein said first layer is polyester, said second layer is rubber and said third layer is sealed gas.

8. The system of claim 1 further including a fourth layer connected with said third layer wherein said fourth layer is a water impervious layer.

9. The system of claim 8 wherein said fourth layer is polyester.

10. A shark avoidance system comprising:

a. an open ended enclosure with a top, sides and a bottom, said sides and said bottom forming an interior enclosed space; and b. a buoyant device and two inflatable devices, wherein said buoyant device and said two inflatable devices are connected to form a combination and wherein said combination is connected with said top of the open ended enclosure;

c. wherein said sides connect said top and said bottom, wherein said sides and said bottom form a flexible wall and wherein said flexible wall consists of a combination of four layers, a first, Outer, layer, a second, middle, layer and a third, inner, layer, and a fourth, innermost, layer, said fourth layer connected to said third layer, said third layer connected to said second layer and said second layer connected to said first layer, wherein said first layer is a water impervious polyester layer, wherein one of said layers is a bioelectrical blocking rubber layer, wherein one of said layers is a sound emission blocking layer of sealed gas and wherein said fourth layer is a water impervious polyester layer.

11. The system of claim 10 wherein said combination is connected to said top with said buoyant device.

12. The system of claim 10 wherein said inflatable devices include more than one segregated inflatable section such that each section is independently inflatable.

13. The system of claim 10 farther including inflation tubes connected with said inflatable devices.

14. The system of claim 10 wherein, said first layer is polyester, said second layer is rubber, said third layer is sealed gas and said fourth layer is polyester.

15. The system of claim 10 wherein said first layer is colored and wherein said color is selected from a group consisting of, dark blue, light blue and black.

16. The system of claim 10 further including a pair of oppositely positioned handles in said interior enclosed space.

17. A shark avoidance method comprising:

a. providing an open ended enclosure with a top, sides, a bottom, said sides and said bottom forming an interior enclosed space; and a buoyant device and an inflatable device, wherein said buoyant device and said inflatable device are connected to form a combination and wherein said combination is connected with said top of the open ended enclosure; wherein said sides connect said top and said bottom, wherein said sides form a flexible wall and wherein said flexible wall consists of a combination of at three layers, a first, outer, layer, a second, middle, layer and a third, inner, layer, said third layer connected to said second layer and said second layer connected to said first layer, wherein one of said layers is a water impervious polyester layer, wherein one of said layers is a bioelectrical blocking rubber layer and wherein one of said layers is a sound emission blocking layer of sealed gas; and b. a user placing said enclosure in water and then entering the interior enclosed space through the top of the open ended enclosure such that the open ended enclosure surrounds the user.

18. The method of claim 17 further including the step of inflating the inflatable device.

19. The method of claim 17 wherein said first layer is polyester, said second layer is rubber and said third layer is sealed gas.

20. The method of claim 17 further including a fourth layer connected with said third layer wherein said fourth layer is a water impervious layer.

* * * * *